US007565809B2

(12) United States Patent
Takeda

(10) Patent No.: US 7,565,809 B2
(45) Date of Patent: Jul. 28, 2009

(54) CIRCULATION-TYPE LIQUID HELIUM RELIQUEFACTION APPARATUS WITH CONTAMINANT DISCHARGE FUNCTION, METHOD OF DISCHARGING CONTAMINANT FROM THE APPARATUS, AND REFINER AND TRANSFER TUBE BOTH OF WHICH ARE USED FOR THE APPARATUS

(75) Inventor: Tsunehiro Takeda, Ibaragi (JP)

(73) Assignee: Japan Science and Technology Agency, Saitama (JP)

( * ) Notice: Subject to any disclaimer, the term of this patent is extended or adjusted under 35 U.S.C. 154(b) by 436 days.

(21) Appl. No.: 10/544,100

(22) PCT Filed: Sep. 18, 2003

(86) PCT No.: PCT/JP03/11886

§ 371 (c)(1),
(2), (4) Date: Apr. 21, 2006

(87) PCT Pub. No.: WO2004/070296

PCT Pub. Date: Aug. 19, 2004

(65) Prior Publication Data

US 2006/0230766 A1 Oct. 19, 2006

(30) Foreign Application Priority Data

Feb. 3, 2003 (JP) ..... 2003-025525

(51) Int. Cl.
*F17C 3/10* (2006.01)
*B01D 8/00* (2006.01)
*B01D 9/04* (2006.01)

(52) U.S. Cl. ..... 62/48.2; 62/55.5; 62/532

(58) Field of Classification Search ..... 62/48.2, 62/55.5, 532, 50.7
See application file for complete search history.

(56) References Cited

U.S. PATENT DOCUMENTS 3,105,360 A * 10/1963 Lehmer et al. ..... 62/647

(Continued)

FOREIGN PATENT DOCUMENTS

| | | | |
|---|---|---|---|
| EP | 1 197 716 | A1 | 4/2002 |
| JP | 02-056213 | A | 2/1990 |
| JP | 07-260094 | A | 10/1995 |
| JP | 2000-105072 | A | 4/2000 |

(Continued)

OTHER PUBLICATIONS

International Search Report mailed on Nov. 25, 2003.

*Primary Examiner*—William C Doerrler
(74) *Attorney, Agent, or Firm*—Rader, Fishman & Grauer, PLLC

(57) ABSTRACT

This invention relates to a circulation type liquid helium recondensation device with a contaminant-purging function capable of vaporizing and removing contaminants deposited on the refiner in the device. Helium gas vaporizing in the liquid helium storage tank 2 is pumped by the circulating pump 7 and refined in the refiner 6. The refiner is provided with heaters and also a discharge circuit on the inflow side. The vaporized contaminants generated when the refiner 6 is heated by the heaters are pumped by the circulating pump 7 or the dedicated purge pump 8 and vented to the atmosphere via said discharge circuit.

33 Claims, 7 Drawing Sheets

U.S. PATENT DOCUMENTS 3,125,863 A * 3/1964 Hood ..... 62/175
3,415,069 A * 12/1968 Hauser ..... 62/639
3,981,699 A * 9/1976 Molitor ..... 96/127
4,283,367 A * 8/1981 Koeppe et al. ..... 422/159
5,853,459 A * 12/1998 Kuwamoto et al. ..... 95/273
5,992,158 A * 11/1999 Goddard et al. ..... 62/51.2
6,070,413 A * 6/2000 Ward ..... 62/50.7
6,345,451 B1 * 2/2002 Arslanian et al. ..... 34/428
6,442,948 B1 * 9/2002 Takeda ..... 62/48.2

FOREIGN PATENT DOCUMENTS

JP 2001-248964 A 9/2001
JP 2000-193364 A 4/2002

* cited by examiner

CIRCULATION-TYPE LIQUID HELIUM RELIQUEFACTION APPARATUS WITH CONTAMINANT DISCHARGE FUNCTION, METHOD OF DISCHARGING CONTAMINANT FROM THE APPARATUS, AND REFINER AND TRANSFER TUBE BOTH OF WHICH ARE USED FOR THE APPARATUS

TECHNICAL FIELD

This invention relates to a circulation type liquid helium recondensation device with a contaminant-purging function and the contaminant-purging method used in the device. Specifically, this invention relates to a circulation type liquid helium recondensation device with a contaminant-purging function designed to efficiently vaporize and remove contaminants from the refiners installed in a device such as one designed to sustain a magnetoencephalograph or similar device at a cryogenic temperature using liquid helium, and as well as relates to the contaminant-purging method and the refiners and transfer tubes used in said device.

BACKGROUND ART

Liquid helium is indispensable in most cryogenic studies and for cooling measuring instruments that use superconducting elements. Liquid helium for cooling evaporates and is released to the atmosphere after use in most cases. Liquid helium is a rare resource and is expensive. A strong demand exists to recover and condense evaporated helium gas for reuse.

A recirculation system was recently publicized in which all the helium gas evaporated in the storage tank is recovered and condensed to liquid again after removing the contaminants within the system (Reference 1: Publication of unexamined patent application No. 105072-2000).

That system is, however, unable to prevent gradual intrusion of small amounts of oxygen, nitrogen or other contaminants into the helium gas through various seals in the system. In the helium gas cooling process, these small amounts of oxygen, nitrogen or other contaminants are frozen and attach to various components of the system eventually preventing the system from functioning properly.

To solve these problems, the inventors have already developed a helium gas refiner to remove the contaminants after solidifying them. The helium gas refiner solidifies the contaminants within the refiner while the system is operating. When a preset amount of solid contaminants are accumulated, the contaminants are liquefied by the heaters installed on the refiner for this purpose and the liquefied contaminants are discharged from the refiner system using an appropriate means (Reference 2: Patent application No. 2002-16430).

Contaminants enter the system piping little by little regardless of how tightly the system is sealed. The resultant solids develop in many unforeseeable locations. For these reasons, even if a helium gas refiner with a simply large capacity is produced, occlusion occurs earlier than expected making the unit unusable at some point in time.

Discharging the contaminants from the system after liquefaction means that until then the contaminants must be kept in the liquid phase without evaporation in the refiner. This calls for subtle temperature control of the heaters and involves a complex procedure. It is also a troublesome job to remove the liquefied contaminants from the refiner.

The inventors improved the refiner and developed a new technology to vaporize and purge the solidified contaminants from the system.

This invention described in this document is made based on the above knowledge and it is a circulation type liquid helium recondensation device that can be run for a long time period, in which evaporated helium gas is pumped from the liquid helium storage tank using a circulating pump, refined in the refiner, and liquefied and returned to the liquid helium storage tank for reuse; said refiner is provided with heaters to heat the refiner itself when the amount of the contaminants reaches a preset level to vaporize said contaminants by heat and discharge them to the atmosphere using a pump installed in the device. This invention also is the method of purging the contaminants from said device.

Another objective of this invention is to provide the high thermal gradient helium gas refiner used in the circulation type liquid helium recondensation device to remove contaminants from helium gas and vaporize them to facilitate their discharge from the system.

The other objective of this invention is to provide the transfer tubes used in the circulation type liquid helium recondensation device that feature low heat intrusion from the outside when helium gas is circulating, thereby dramatically improving on energy loss.

DISCLOSURE OF THE INVENTION

The technical means to achieve the above objectives offered by this invention are:

A circulation type liquid helium recondensation device with a contaminant-purging function designed to pump helium gas evaporating from the liquid helium storage tank using a circulating pump, refine the pumped helium gas in the refiner, liquefy the gas, and return the liquefied helium to the liquid helium storage tank for recycling in which said refiners are provided with heaters and also a discharge circuit on the inflow side, and the contaminants that vaporize when the refiners are heated by said heaters are pumped and discharged to the atmosphere via said discharge circuit;

A circulation type liquid helium recondensation device with a contaminant-purging function in which a dedicated purge pump is installed in said discharge circuit to pump and discharge vaporized contaminants to the atmosphere;

A circulation type liquid helium recondensation device with a contaminant-purging function in which mass flow controllers are installed on the inflow side of said refiners to control the flow rate of the incoming helium gas;

A circulation type liquid helium recondensation device with a contaminant-purging function in which two or more valves are installed on the inflow side of said refiners to control the flow rate of the incoming helium gas by combining said valves;

A circulation type liquid helium recondensation device with a contaminant-purging function in which said discharge circuit is a circuit connecting the inflow side circuit of the refiner and the inflow valve of said circulating pump and electromagnetic valve for discharge is installed in said discharge circuit, and another electromagnetic valve for atmospheric discharge is installed on the downstream side of said circulating pump;

A circulation type liquid helium recondensation device with a contaminant-purging function in which condensing pots are installed to store the refined helium from the refiner as gas or liquid at near-4K temperature and said condensing pots are provided with heaters;

A circulation type liquid helium recondensation device with a contaminant-purging function in which said liquid helium storage tank (dewar) is provided with an electromagnetic valve to regulate the pressure of the liquid helium storage tank;

A contaminant-purging method for the circulation type liquid helium recondensation device that is employed in the liquid helium recondensation procedure comprising the operating steps of pumping the helium gas evaporating from the liquid helium storage tank using a circulating pump, refining the pumped helium gas in the refiner, liquefying the gas, and returning the liquefied helium to the liquid helium storage tank for recycling, in which said refiner is heated to vaporize the contaminants deposited on the refiner and the vaporized contaminants are discharged to the atmosphere;

A contaminant-purging method for the circulation type liquid helium recondensation device that is employed in the liquid helium recondensation procedure comprising the operating steps of pumping the helium gas evaporating from the liquid helium storage tank using a circulating pump, refining the pumped helium gas in the refiner, liquefying the gas, storing the liquefied helium in a condensing pot, and transferring the liquid helium from said condensing pot to the liquid helium storage tank for recycling in which at least either of said condensing pot or said refiner is heated to vaporize the contaminants deposited on the refiner and the vaporized contaminants are discharged to the atmosphere;

A contaminant-purging method for the circulation type liquid helium recondensation device in which said vaporized contaminants are pumped by a dedicated pump and discharged to the atmosphere;

A contaminant-purging method for the circulation type liquid helium recondensation device in which said vaporized contaminants are pumped by a circulating pump and discharged to the atmosphere;

A contaminant-purging method for the circulation type liquid helium recondensation device in which heating of said condensing pot or refiner starts when the pressure in the refiner rises to a preset level and stops when the pressure falls to a preset level;

A contaminant-purging method for the circulation type liquid helium recondensation device in which heating of said condensing pot or refiner starts when the flow velocity in the refiner falls to a preset level and stops when the flow velocity rises to a preset level;

A contaminant-purging method for the circulation type liquid helium recondensation device in which heating and cooling of said condensing pot or refiner is performed in this sequence of modes: heating/back-flow, cooling, circulation recovery, and liquid level recovery;

A refiner for the circulation type liquid helium recondensation device with a contaminant-purging function designed to pump helium gas evaporating from the liquid helium storage tank using a circulating pump, refine the pumped helium gas in the refiner, liquefy the gas, and return the liquefied helium to the liquid helium storage tank for recycling in which said refiner is made up of a thermally conductive housing, with the contaminant solidification unit installed on the housing, an infeed means to transfer helium gas to said housing, and a heating means to vaporize the contaminants attached to said solidification unit, and in which the contaminants vaporizing in the refiner are discharged from the refiner to the atmosphere via said infeed means;

A refiner for the circulation type liquid helium recondensation device with a contaminant-purging function in which said contaminant solidification unit is a staggered zigzag passage made up of thermally conductive fins;

A refiner for the circulation type liquid helium recondensation device with a contaminant-purging function in which said infeed means is supported on the housing via a component that reduces the thermal gradient;

A helium gas refiner in which said component to reduce the thermal gradient is a stainless steel telescopic component;

A transfer tube for the circulation type liquid helium recondensation device designed to pump helium gas evaporating from the liquid helium storage tank using a circulating pump, refine the pumped helium gas in the refiner, liquefy the gas, and return the liquefied helium to the liquid helium storage tank for recycling in which said transfer tube comprises a tube for flowing liquid helium at about 4K (near-4KL) at the center, another for flowing liquid helium gas at about 4K (near-4KG) coaxially arrayed outside the central tube, and the other for flowing liquid helium gas at about 40K coaxially arrayed outside the second tube, and in which a vacuum insulation layer is formed between adjacent tubes and outside the most external tube;

A transfer tube for the circulation type liquid helium recondensation device in which the heaters are connected to the tip of the vacuum insulation layer provided between the near-4K liquid helium tube and the coaxially arrayed near-4K liquid helium gas tube and at the tip of the vacuum insulation layer provided outside and around the near-40K liquid helium gas tube.

BEST MODE OF IMPLEMENTING THE INVENTION

The circulation type liquid helium recondensation device of this invention is described below.

Figure 1:
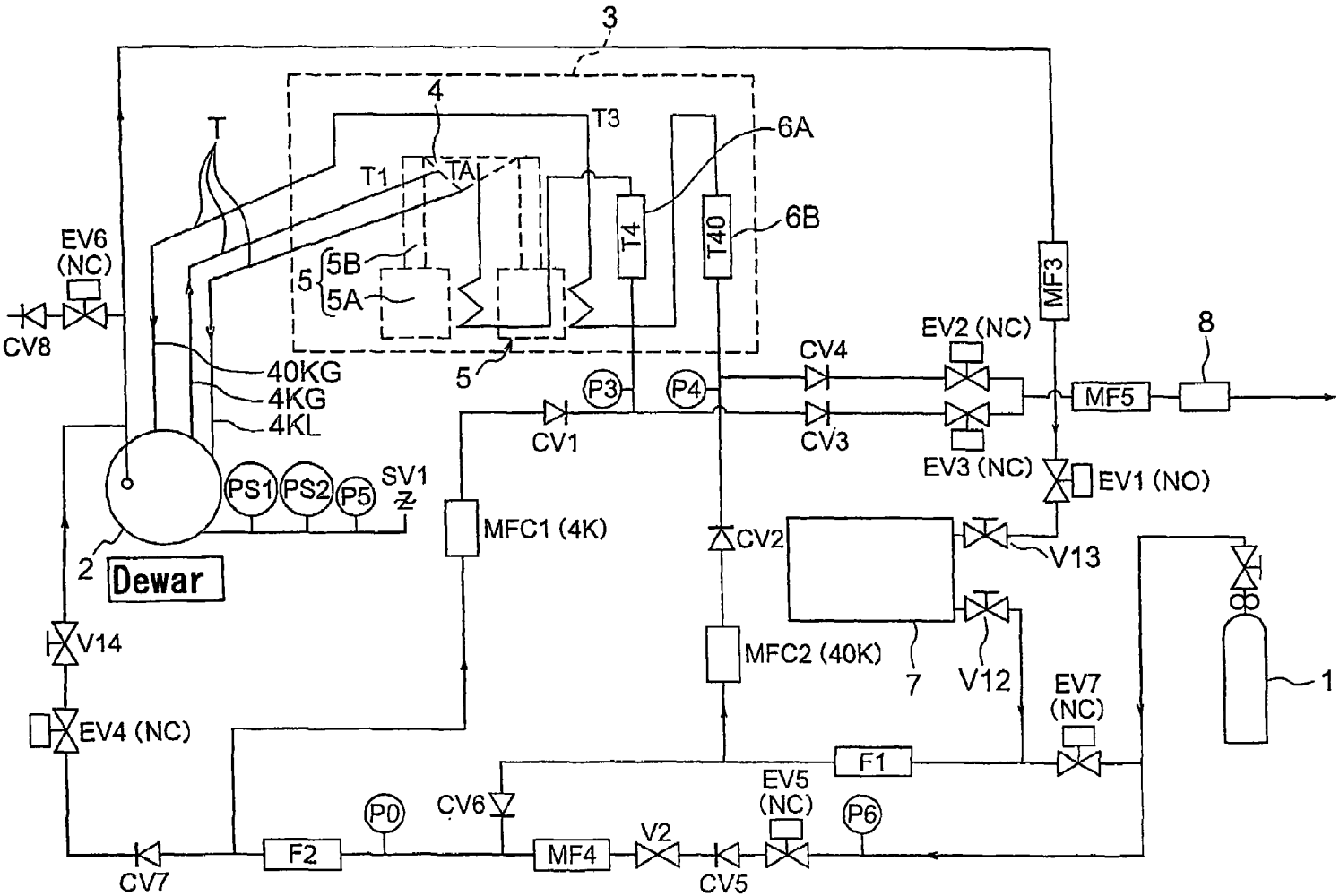
FIG. 1 shows the structure of the circulation type liquid helium recondensation device of this invention.
Figure 2:
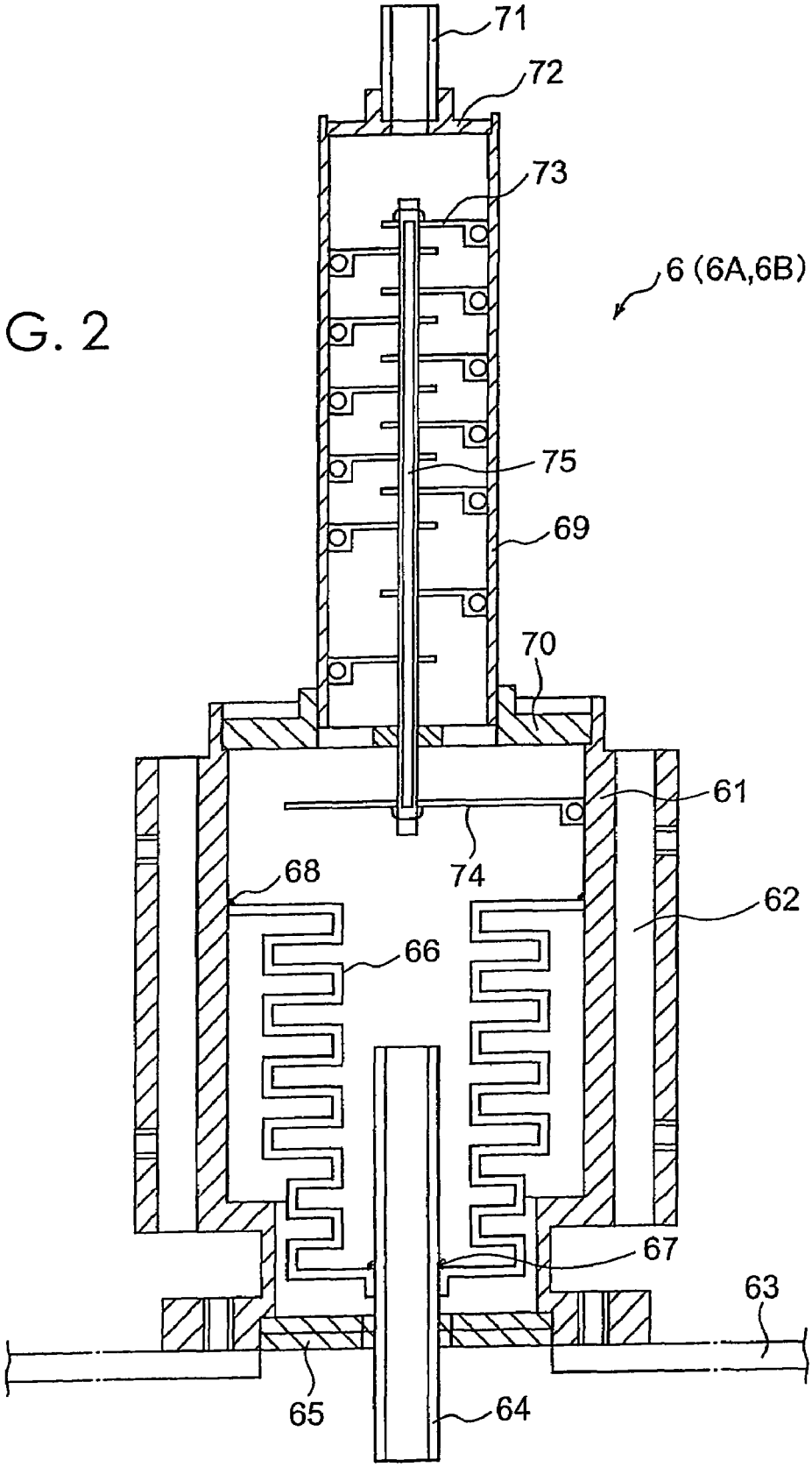
FIG. 2 shows the structure of the refiner used in said circulation type liquid helium recondensation device of this invention.
Figure 3:
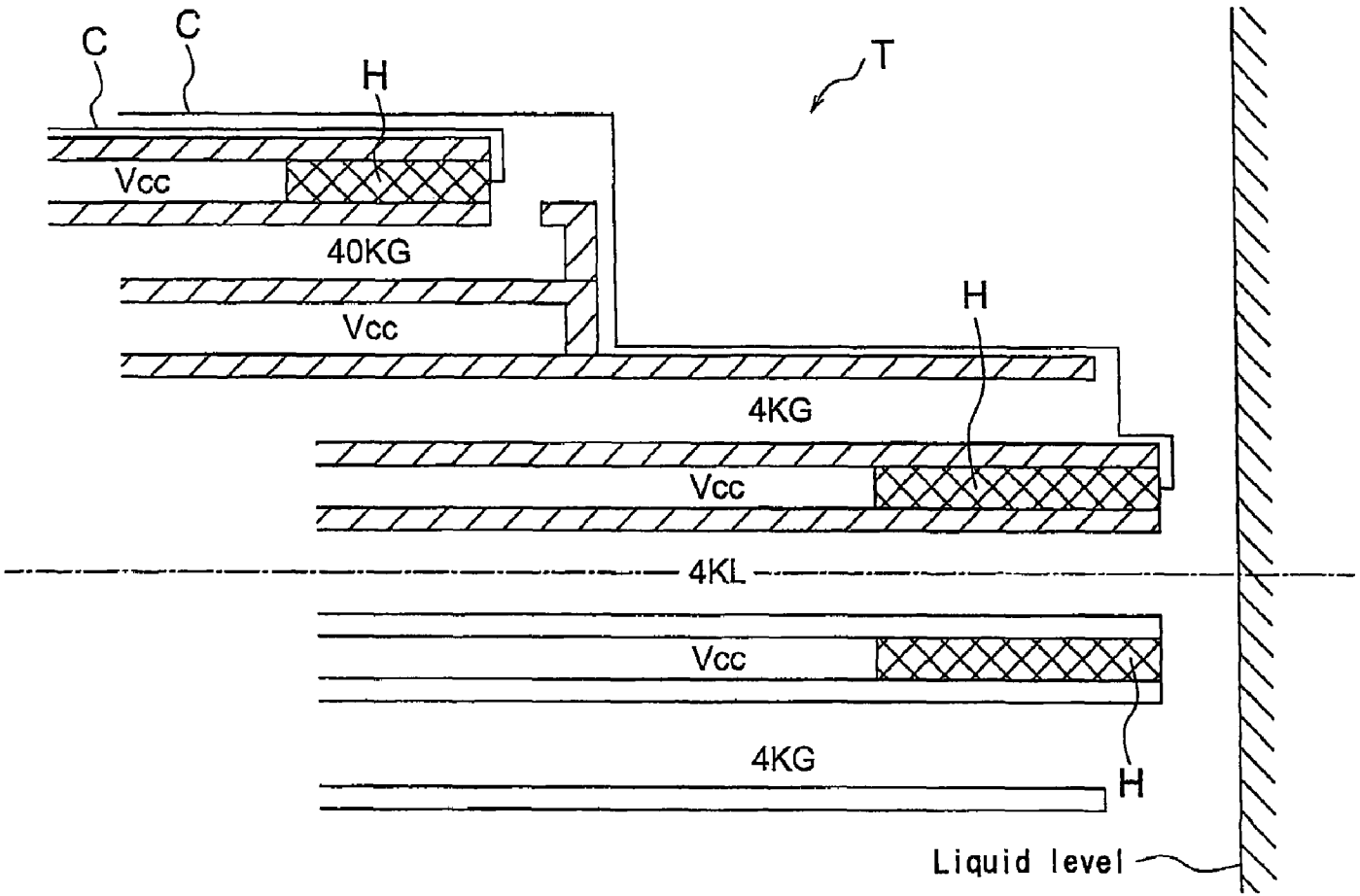
FIG. 3 shows a cross-section of the transfer tube used in said circulation type liquid helium recondensation device of this invention.
Figure 4:
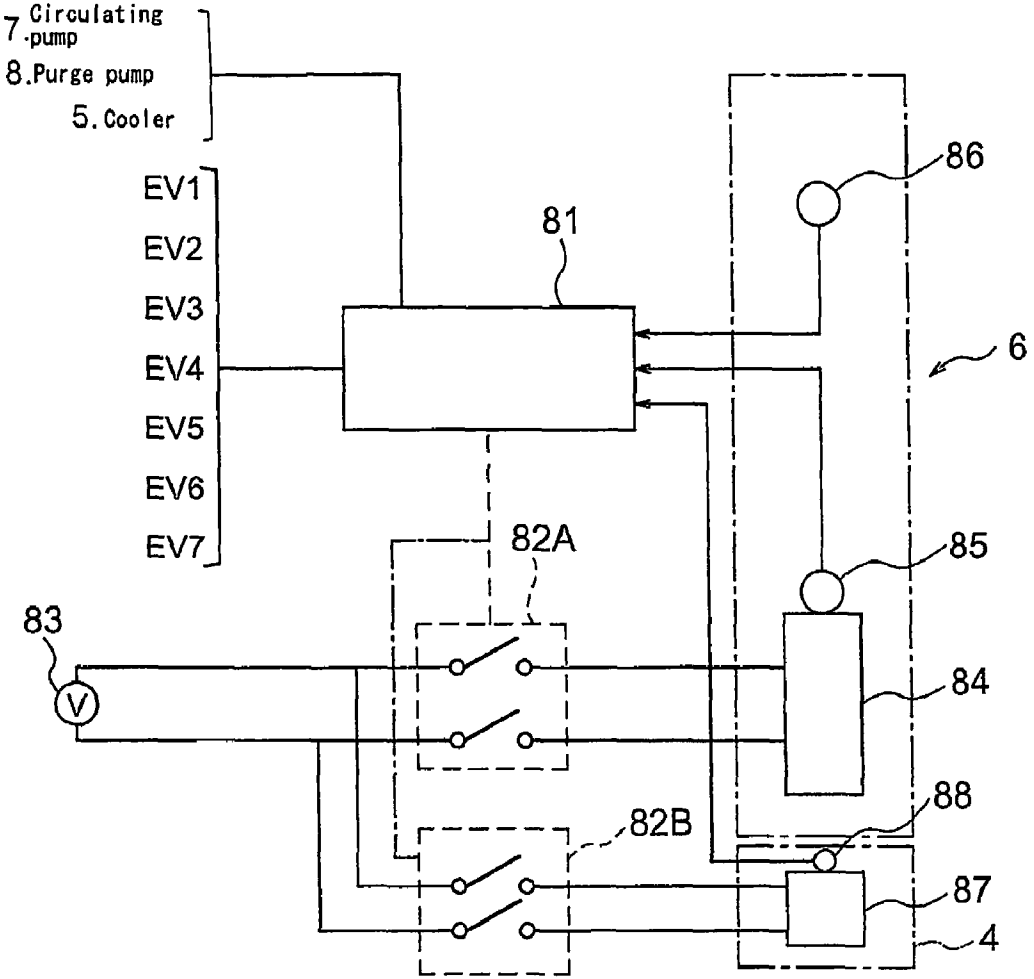
FIG. 4 shows the control block diagram for the heaters installed on the refiner of this invention.
Figure 5:
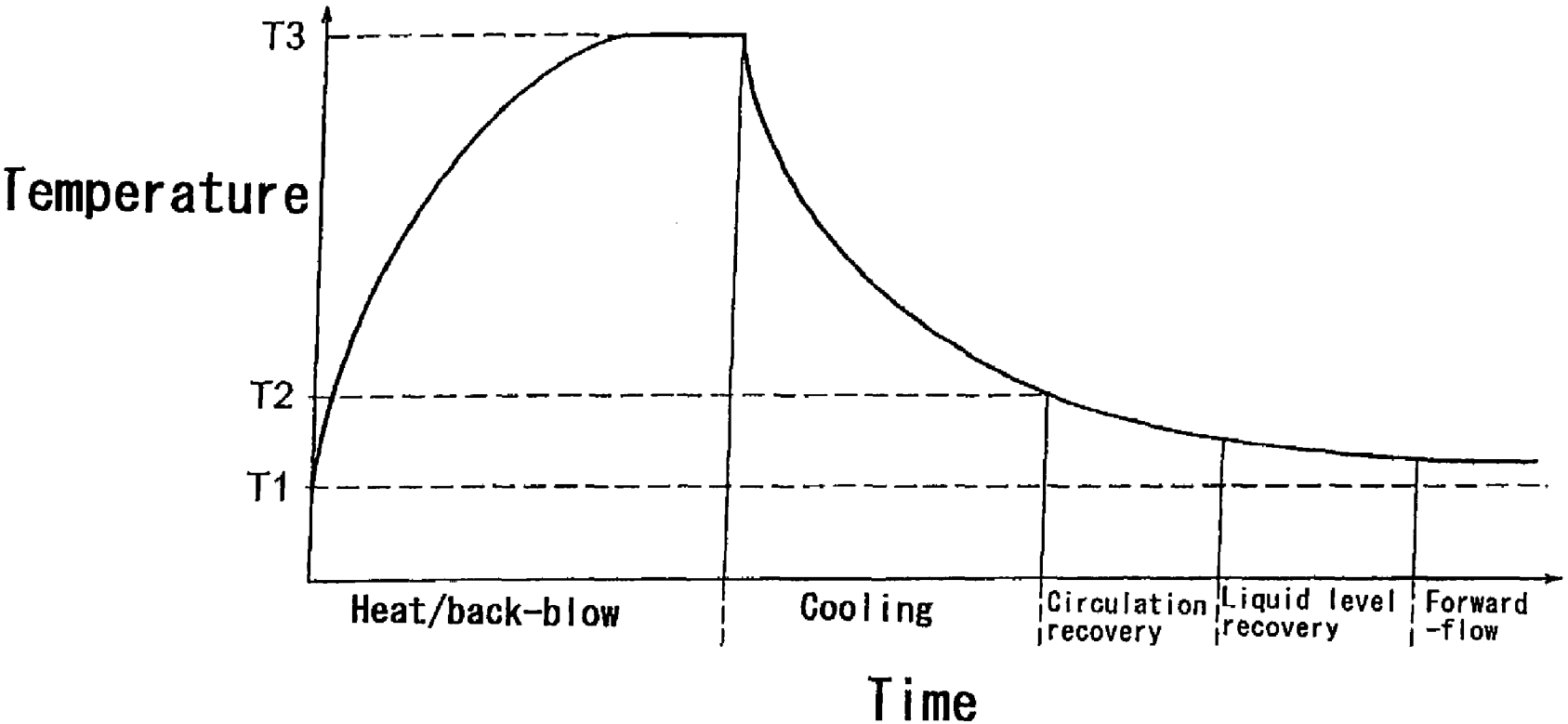
FIG. 5 illustrates heater operation and purging of the contaminants.

FIG. 1 shows the structure of the first embodiment of the circulation type liquid helium recondensation device of this invention. FIG. 2 shows the structure of the refiner used in said circulation type liquid helium recondensation device of this invention. FIG. 3 shows a partial cross-section of the transfer tube. FIG. 4 is the control block diagram for the heaters installed on the refiner. FIG. 5 illustrates the operation of the heaters and purging of the contaminants.

In FIG. 1, 1 is the helium gas cylinder, 2 dewar (liquid helium storage tank), 3 cold box, 4 condensing pot with heaters (heaters are not shown), and 5 two large-capacity coolers that are commercially available as a result of remarkable technological progress in recent years; each consisting of the 1st cooling stage 5A to cool the helium gas to about 40K and the 2nd cooling stage 5B to cool the helium gas from about 40K to about 4K. 6A is the 1st refiner with heaters installed in the near-4K line, 6B the 2nd refiner with heaters installed in the near-40K line, 7 circulating pump, and 8 purge pump. PS1, PS2, P0, and P3 through P5 are pressure gauges, V12 and V13 the outflow and inflow valve of the circulating pump, respectively, V2 and V14 transfer valves, CV1 through CV8 check valves, and MFC1 and MFC2 constant flow control valves for flow control of the near-4K and near-40K lines, respectively. MF3 through MF5 are mass flowmeters. EV1 is a normally open electromagnetic valve. EV2 through EV7 are normally closed electromagnetic valves, F1 and F2 filters, and SV1 safety valve. The temperature of the heaters installed on said condensing pot is adjustable in at least 2 stages. The heaters are used at their maximum capacity, for example about 1 kW, when vaporizing contaminants in the refiners 6A and 6B in the mode described later. In normal operation, the heaters are controlled at their lowest capacity, for example about 2 W. The heaters may be individual heaters or be replaced with one integral heater with temperature controlled as required. The number of said coolers 5 may be increased or decreased as required. Two coolers each adjustable in two stages are used in the embodiments of this invention but they may be replaced with coolers adjustable in multiple stages or with just one cooler without affecting the effect of this invention. The passage (circuit) connecting the condensing pot 4 in the cold box 3, cooler 5, and dewar 2 uses the transfer tube T that provides for more than two lines as described in detail later. The 1st and the 2nd refiner 6A and 6B, respectively, and the condensing pot 4 are provided with heaters (described in detail later) that are turned on when, for instance, removing contaminants.

In this embodiment, the mass flowmeter MF5 connects to the inflow side of the 1st and the 2nd refiners 6A and 6B, respectively, via check valves CV3 and CV4 and electromagnetic valves EV2 and EV3, respectively. Mass flowmeter MF5 also connects to the purge pump 8. The two circuits may be merged upstream of the check valves CV3 and CV4 to use just one check valve and one electromagnetic valve in place of two each. Alternatively, the merging point maybe downstream of the check valves CV3 and CV4. Selection may be freely made in the design stage of the system to be developed.

The inflow side of the constant flow control valve MFC1 in the near-4K line connects to the dewar 2 via check valve CV7, normally closed electromagnetic valve EV4, and transfer valve V14 as shown.

The normally closed electromagnetic valve EV6 is installed on the circuit connecting dewar 2 and mass flowmeter MF3 to extract high-temperature helium gas from the neck tube of the dewar 2. Check valve CV8 is installed downstream of said electromagnetic valve EV6.

All the components of the system are connected to each other by piping as shown. The basic structure is the same as that of a conventional circulation type liquid helium recondensation device.

All the electromagnetic valves, valves and related components may be replaced with electromagnetic valves or manual valves. The valves used in the system may be partly omitted or increased in number. The 1st and the 2nd refiners 6A and 6B, respectively, are described in detail later.

An example of the operation of the circulation type liquid helium recondensation device of this invention is explained below.

[Normal Operation]

As is generally known and understood, helium gas evaporating in the dewar 2 leaves the dewar 2 from its neck tube and flows through the mass flowmeter MF3, normally open electromagnetic valve EV1, inflow valve V13, circulating pump 7, outflow valve V12 and filter F1. The circuit then diverges in two directions. One circuit runs through the constant flow control valve MFC2 in the near-40K line, check valve CV2, the 2nd refiner 6B, in which the gas is refined and reaches the cooler 5. The other circuit passes through the check valve CV6, filter F2, constant flow control valve MFC1 in the near-4K line, check valve CV1, the 1st refiner 6A, in which the gas is refined and reaches the cooler 5. The refined helium gas in the 1st refiner 6A is cooled to about 40K in the 1st cooling stage 5A of the cooler 5. The cooled helium gas is, as shown in FIG. 1, supplied to the dewar 2 through the neck of the dewar as a cooling helium gas at about 40K. Helium gas in the near-4K line that is refined in the 2nd refiner 6B is, as shown in FIG. 1, cooled to about 40K in the 1st cooling stage 5A of the cooler 5, then further cooled in the 2nd stage 5B and supplied to the condensing pot 4. The condensing pot 4 is cooled to about 4K by cryogenic energy from the 2nd stage 5B. Helium gas supplied to the condensing pot is liquefied and supplied to the dewar 2. A portion of the near-4K gas generated in the dewar 2 returns to the condensing pot 4, in which it is liquefied again.

[Low Helium Gas During Normal Operation]

When the device is supercooled in normal operation, helium gas is liquefied more than necessary to decrease the pressure of the dewar 2. Upon detecting pressure drop, the heater of the lowest capacity (about 2 W) in the condensing pot is turned on to increase the temperature and prevent pressure drop in the dewar 2. When liquid helium is low in the dewar 2, the normally closed electromagnetic valve EV5 opens as required to make up the deficiency of the gas to the 1st refiner 6A via the mass flowmeter MF4 and the constant flow control valve MFC1 in the near-4K line, and the refined helium gas is cooled in the cooler and supplied to the dewar 2. As soon as the helium gas is supplied sufficiently to increase the pressure in the dewar 2 to the specified level, the normally closed electromagnetic valve EV5 closes to stop the supply of helium gas from the helium gas cylinder 1 and maintain the pressure in the dewar 2 at an appropriate level. Helium gas may be supplied from the helium gas cylinder 1 through not only the normally closed electromagnetic valve EV5 but also the normally closed electromagnetic valve EV7, or through both as required.

[Removal of Contaminants from the Refiner]

When contaminants accumulate (solidify) exceeding the specified limit in the 1st and the 2nd refiners 6A and 6B, respectively, (the structure of which will be described in detail later) during the normal operation of the circulation type liquid helium recondensation device, liquefaction of the helium gas stops temporarily and the heaters in the 1st and 2nd refiners 6A and 6B, respectively, as well as the heater of the maximum capacity (1 kW) installed on the condensing pot are turned on. (It is possible to turn on the heaters of the refiners only, the heater of the condenser only, or both the heaters of the refiners and the heater of the condenser together.) As a result, the 1st and the 2nd refiners 6A and 6B, respectively, are heated and the solid contaminants that are attached to the fins (the structure of which will be explained in detail later) vaporize. Electromagnetic valves EV2 and EV3 are open at this time and the purge pump 8 starts to purge the vaporized contaminants from the system to the atmosphere. When the high capacity heater (about 1 kW) installed on the condensing pot 4 is turned on and working, the refiners 6A and 6B are heated by thermal conduction and helium gas in the condensing pot 4 is heated at the same time. The warm helium gas runs in reverse into the 1st and the 2nd refiners 6A and 6B, respectively. Contaminants in the 1st and the 2nd refiners 6A and 6B, respectively, thus vaporize to be removed easily and the device is once again capable of refining helium gas. Heater control will be described in detail later.

[Return to Normal Operation of the Device]

To operate the circulation type liquid helium recondensation device again, the heaters in the 1st and the 2nd refiners 6A and 6B, respectively, as well as the heater on the condensing pot 4 turn off and the normally closed electromagnetic valves EV2 and EV3 close. The purge pump 8 stops. Then the cooler 5 starts to cool the device gradually. The circulating pump 7 will start when the temperature of the refiners 6A and 6B drops to the operating temperature. Helium gas is pulled into the dewar 2 to start the liquefaction process.

The following are descriptions of typical examples of operation of the heaters installed on the 1st and the 2nd refiners 6A and 6B, respectively (hereafter called refiner 6), the functioning of the circulating pump 7 and purge pump 8 referring to FIG. 4, and the operation of the control block that controls the closing and opening of individual valves and the heater control referring to FIG. 5.

The heaters of the 1st and the 2nd refiners 6A and 6B and the heater of the condensing pot are basically turned on simultaneously when the sensor of either refiner detects contaminants but these heaters may be turned on separately.

In FIG. 4, the refiner 6 is provided with a heater 84, temperature sensor 85, and contaminant detection sensor 86. The condensing pot 4 is provided with a heater 87 and temperature sensor 88. The heaters 84 and 87 connect to the power source 83 via relay switches 82A and 82B, respectively. The normally open relay switches 82A and 82B close on receiving the command from the controller 81. The controller 81 connects to the cooler 5, circulating pump 7, purge pump 8, electromagnetic valves EV1 through EV7, and contaminant detection sensor 86 installed on the refiner 6 (a pressure sensor, a flow velocity sensor or a sensor to detect the thickness or other property of the contaminants that accumulate in the refiner). The controller 81 also connects to the temperature sensors 85 and 88 to monitor the temperature of the heaters 84 and 87, respectively.

An example of the heater control sequence by the above control block is described below referring to FIG. 5.

The heater 87 on the condensing pot should preferably be controlled in the same pattern as the heater 84 of the refiner 6 but may be controlled separately (independent control of the heaters).

[Heating and Back-flow Mode]

The controller 81 issues the command to stop the cooler 5 when the contaminant detection sensor 86 installed on the refiner 6 senses that the contaminants that have accumulated exceed the preset level. The relay switches 82A and 82B turn on to turn on the heaters 84 and 87, thereby starting the heating/back-flow mode (FIG. 5). The normally closed electromagnetic valves EV2 and EV3 open and the purge pump 8 discharges the contaminants vaporized in the refiner 6 to the atmosphere. Temperature of the heaters 84 and 87 increases sharply until it reaches the preset temperature T3 (FIG. 5). The heaters maintain the temperature T3 for a given time period (in order for the contaminants accumulated and solidified in the refiner to vaporize completely, for example approximately 60 minutes) by repeatedly turning on and off.

[Cooling Mode]

The heaters are turned off and the cooler resumes operation when the contaminants completely vaporize and are discharged to the atmosphere. The entire circulation type liquid helium recondensation device, which was heated by the heaters, is cooled in the cooling mode. Because the entire system must be cooled in the shortest possible time, the normally closed electromagnetic valves EV2 and EV3 close and the purge pump 8 stops almost as soon as the cooler resumes operation. The device gradually cools down as the cooler 5 operates and the circulating pump 7 starts operation. Helium gas starts circulating while the cooler 5 and the circulating pump 7 continue to run to decrease the temperature of the device sharply (FIG. 5). The amount of helium gas in the device decreases due to the temperature drop possibly generating a negative pressure in the device which could induce influx of contaminants from outside. To avoid generation of a negative pressure in the device, electromagnetic valves EV5 and EV7 open as required in the cooling mode to supply clean helium gas a small amount at a time from the helium gas cylinder 1 to the device. The system enters the circulation recovery mode when the temperature of the device falls to T2 (about 40K). Throughout this mode, the electromagnetic valves EV4 through EV7 are controlled so that the pressure in the dewar 2 is maintained within the first specified pressure range (dewar pressure between 4 and 5 Pa, for example). This effectively prevents excess pressure and negative pressure in the dewar 2.

[Circulation Recovery Mode]

The helium gas refining process starts again when the specified time period has elapsed and the cooling mode ends, with the temperature of the refiners 6A and 6B dropped to about 40K. Throughout the circulation recovery mode, helium gas circulates through the constant flow control valves MFC1 and MFC2 in the near-4K and near-40K lines, respectively, controlled to keep the pressure of the dewar 2 within the second specified pressure range (Dewar pressure between 900 and 1200 Pa, for example.) (The flow rate of the near-4K line is increased gradually.) Pressure in the dewar 2 is regulated by opening and closing the electromagnetic valves EV4 and EV6 as required but it is also possible to regulate the dewar pressure by controlling the supply of helium gas from the gas cylinder 1 to the dewar 2 as required.

[Liquid Level Recovery Mode]

The liquid level in the dewar 2 is low when the circulation recovery mode ends. The electromagnetic valve EV5 opens to supply clean helium gas from the helium gas cylinder 1 to the near-4K line to restore the preset liquid level in the dewar 2. Helium gas supplied from the helium gas cylinder 1 is liquefied in the cooler 5 in a large quantity to increase the supply of liquid helium to the near-4K line to restore the liquid level in the dewar 2.

[Forward-flow Mode]

The system returns to the normal operation mode when the liquid level recovery mode ends.

FIG. 5 is presented only as an example of control in the above modes of operation. In practice, the patterns of the modes can vary depending on the size of the device, and the valves and heaters can have different operations and behaviors. The timing of the helium gas supply may also vary with respective devices. All these factors can be adequately programmed in the design stage in the development of a device. It is possible to use all electromagnetic valves throughout the system and open or close all valves by commands from the controller. The other alternative would be to use manual valves throughout the system.

An example of the refiner used in the above device is presented below. FIG. 2 shows a cross-section of the refiner.

In FIG. 1, two refiners (the 1st and the 2nd refiners 6A and 6B, respectively) are installed in the cold box 3. Since the refiners have the same structure, only the 1st refiner 6A (hereafter called refiner 6) is explained.

The refiner 6 has a cylindrical housing 61 made of copper or other thermally conductive material as shown in FIG. 2. A space 62 is provided outside the housing 61 to accommodate heaters (not shown). The bottom of the housing 61 connects to the 1st cooling stage 5A of the cooler 5 shown in FIG. 1 via the connecting component 63. Because of this construction, the housing 61 is cooled to about 40K.

The housing 61 is provided with a stainless steel infeed pipe 64 at the center through which helium gas generated in the dewar 2 is sent into the housing 61. The infeed pipe 64 is held in place via insulators 65. The housing 61 and the infeed pipe 64 are held in place on the insulation walls of the cold box 3, shown in FIG. 1, via insulating support components. The infeed pipe 64 in the housing 61 is surrounded by the stainless steel telescopic component 66. One end of the telescopic component 66 is fixed on the infeed pipe 64 by welding 67 or a similar method. The other end of the telescopic component 66 is secured on the housing 61 by welding 68 or a similar method. An upper pipe 69 made of thermally conductive material is installed on the housing 61 via a connecting component 70 made of thermally conductive material. The outflow pipe 71 is secured on the top of the upper pipe 69 via a support component 72 also made of thermally conductive material. A number of fins 73 (contaminant solidification unit) made of thermally conductive material are installed on the internal walls of the upper pipe 69 to form a staggered zigzag passage.

The fins 73 are secured on the fixing bar 75 designed to hold the fins. The fixing bar 75 is secured at the bottom by the holder 74 in the housing 61. As mentioned before, all of the housing 61, upper pipe 69, connecting component 70, outflow pipe 71, support component 74, and fixing bar 75 are made of thermally conductive material such as copper so that the fins 73 are cooled to about 40K, or nearly the same temperature as the cooler 5. The fin support structure is not necessarily limited to the above structure provided that the fins 73 are cooled to the temperature at which the contaminants in helium gas solidify (about 40K).

The temperature of the infeed pipe 64 is high, at least about 300K, because helium gas of high temperature (about 300K) generated in the dewar 2 runs into the infeed pipe 64. Temperature of the housing is, as mentioned before, about 40K. To minimize the temperature gradient between the two components, both components are connected by the stainless steel telescopic component 66. The telescopic component 66 is deployed around the infeed pipe 64 to secure the specified space at the outlet of the infeed pipe 64. As a result, a large space is available near the outlet of the infeed pipe 64. This structure prevents the outlet area from being cooled to about 40K through thermal conduction from the housing 61 and, therefore, contaminants will not accumulate in the outlet area.

Helium gas at about 300K enters the housing of the refiner 6 and is cooled to about 40K as it runs through the staggered zigzag passage formed by the fins 73 that are cooled to about 40K. Contaminants (oxygen, nitrogen, etc.) present in the gas are frozen and solidify on the fins 73 in the cooling process for eventual removal from the system. The net product is the clean refined helium gas. After being refined, the near-40K helium gas reaches the 1st cooling stage 5A of the cooler 5 shown in FIG. 1 via the pipe 71. The gas is cooled to about 40K and further cooled to about 4K in the dewar 2 or in the 2nd cooling stage 5B before the gas finally reaches the condensing pot 4.

When contaminants accumulate on the fins 73 in the refiner 6, a sensor (to be described in detail later) detects this condition and turns on the heaters (not shown) installed on the housing 61 via a controller (to be described in detail later) to heat the housing 61 to the temperature at which the contaminants vaporize. The fins 73 connected to the housing 61 by the thermally conductive copper materials are also heated to vaporize the contaminants attached to the fins 73. The vaporized contaminants are discharged to the atmosphere via the normally closed electromagnetic valves EV2 and EV3 shown in FIG. 1 that open upon receiving the command from the controller and via the purge pump 8.

When turning on the refiner heaters, the heater in the condensing pot 4 is also turned on to heat the near-4K gas present in the condensing pot 4. The warm helium gas then backflows from the condensing pot 4 to the 1st refiner 6A. This accelerates vaporization of the contaminants in the 1st refiner 6A (2nd refiner 6B) enabling removal of contaminants and resetting the system to the helium gas refining mode in a short time period.

The transfer tube T connecting the condensing pot 4 and the dewar 2 is described below.

The heat in a magnetoencephalography or similar system is anchored to about 40K at the neck tube of the dewar 2. If the heat at the neck tube is recovered efficiently, the amount of liquid helium to be refilled decreases dramatically and this contributes to a significant reduction in the liquid helium production cost. The inventors use the near-4KGM cooler which has been technically improved considerably in recent years. Most of the recovered gas is supplied to the 1st cooling stage 5A of the cooler 5 via the 2nd refiner 6B shown in FIG. 1 and converted into the low temperature gas at about 40K without being liquefied utilizing the 1st cooling stage of a large capacity cooler. The near-40K low temperature gas is then supplied to the neck tube of the dewar 2 to be recovered as high-temperature gas again thereby exploiting the cooling capacity. A portion of the helium gas recovered from the dewar is supplied to the condensing pot 4 installed on the 2nd cooling stage 5B via the 1st refiner 6A and the 1st cooling stage 5A of the cooler 5. The gas is turned into liquid helium of 4.2K in the condensing pot 4. Liquid helium in the condensing pot 4 flows into the dewar 2 via the near-4K liquid supply line in the transfer tube. It is necessary, at this time, to supply liquid helium to the dewar through a long transfer tube.

Conventional transfer tubes are vulnerable to thermal intrusion. When transferring a small amount of liquid helium, for example 8 liters (liquid) per day, most of the liquid helium is lost by evaporation making it necessary to prepare a large amount of liquid helium to compensate for the loss.

To assure attainment of the objective of this invention by preventing evaporation of the liquid helium, the inventors have developed a multiple coaxial transfer tube with a center pipe for the near-4K liquid helium gas (near-4KL) at the center, the first coaxial pipe for the near-4K helium gas (near-4KG) around the central pipe, and the second and the most external coaxial pipe for the near-40K gas (near-40KG) around the first coaxial pipe. The adjacent lines are separated by the conventional vacuum insulation layer Vcc. The near-40K gas line is heat-anchored to the neck tube of the dewar 2 to retard intrusion of external heat.

The structure of the transfer tube is further described in detail referring to FIG. 3 showing a semi-sectional view of the transfer tube T.

A pipe is set at the center of the transfer tube for passing the near-4K liquid helium (near-4KL). A coaxial pipe is set around the central pipe for passing the near-4K liquid helium gas (near-4KG). The other coaxial pipe is set around the second pipe to pass near-40K liquid helium gas. The openings of the lines locate differently on the dewar 2: the opening of the near-40KG line locates on the neck tube of the dewar 2 while the openings of the near-4KL and the near-4KG lines locate near the liquid level in the dewar 2 as shown in FIG. 1. A vacuum insulation layer Vcc is provided between adjacent pipes and outside the most external pipe. Heaters H are installed at the tip of the vacuum insulation layer Vcc between the liquid helium (near-4KL) pipe and the coaxial near-4K liquid helium gas (near-4KG) pipe and at the tip of the most external vacuum insulation layer Vcc around the most external near-40K liquid helium gas pipe. Cords C are connected to the heaters H to turn on the heaters as required. When contaminants solidify and attach to the tip of the transfer tube T, the heaters are turned on to vaporize or liquefy the solid contaminants as required to open up the closed passage. Operation of these heaters may be interlocked with the refiner heaters or they may be independently controlled. Operation of the heaters can also be freely set to be regulated by the controller or manually.

Refining of the helium gas in the circulation type liquid helium recondensation device of the above construction is described below.

Helium gas evaporating in the liquid helium storage tank (dewar) 2 at a temperature of about 300K enters the infeed pipe 64 of the refiner 6 shown in FIG. 2, passes through the housing 61 and between the fins 73 in the upper pipe 69 to be gradually cooled to about 40K, and is then finally discharged from the outflow pipe 71. Any nitrogen, oxygen or other contaminants present in the helium gas solidify or freeze, for eventual removal, on the fins 73 as they pass through the staggered zigzag passage formed by the fins 73 in the upper pipe 69.

During normal operation the contaminants solidify and accumulate on the fins 73 blocking the passage. The contaminant detection sensor 86 detects the problem and turns on the heater 84 or 87 via the controller 81. The upper pipe 69 and the fins 73 are heated by the heater 84. Helium gas that is heated by the heater 87 back-flows to the refiner. Nitrogen, oxygen or other contaminants solidifying on the fins 73 during heating/back-flow vaporize. Almost simultaneously, the normally closed electromagnetic valves EV2 and EV3 open and the purge pump 8 starts discharging the vaporized contaminants to the atmosphere. Blockage of the fin area 73 or the pipe 71 due to solidification is thus eliminated. As soon as the contaminants are removed from the system, the heaters are turned off, and the circulation type liquid helium recondensation device returns to the normal operation described above. In addition to the control of heater operation based on the information from the contaminant detection sensor that detects the blockage of the refiner as stated above, the heaters may alternatively be pre-programmed to be turned on periodically and with a given cycle if the amount of contaminants that accumulate in the refiner is reasonably predictable in the daily operation based on the expected run time of the liquefying device.

Blockage of passages such as at fins 73 and pipe 71 by contaminants can be detected by receiving various information including but not limited to pressure in the refiner, flow velocity, temperature, and thickness of the contaminants accumulated. The heaters 84 and 87 of the refiner and the condensing pot, respectively, can be turned on and off automatically or manually. The heaters may be turned on only when the pipe pressure reaches a specified level due to blockage of the helium gas passage, only when the pipe temperature reaches a specified level, or upon detecting a certain gas flow velocity in the helium gas passage, or upon detecting two or more of these factors simultaneously.

The second embodiment of this invention is described below. The second embodiment of this invention is basically the same as the first embodiment except that the constant flow control valves MFC1 and MFC1 in the near-4K and near-40K lines, respectively, in the first embodiment are replaced by a combination of two or more valves with different flow rates to achieve a specified flow rate. This different point from the first embodiment is described below. The same codes used in the first and the second embodiments indicate that the relevant components are identical. EV(NO) in the drawings indicates the normally open electromagnetic valve, EV(NC) the normally closed electromagnetic valve, and V the selector valve. The numerals after EV and V indicate the position of the component. The other codes are construed likewise.

Figure 6:
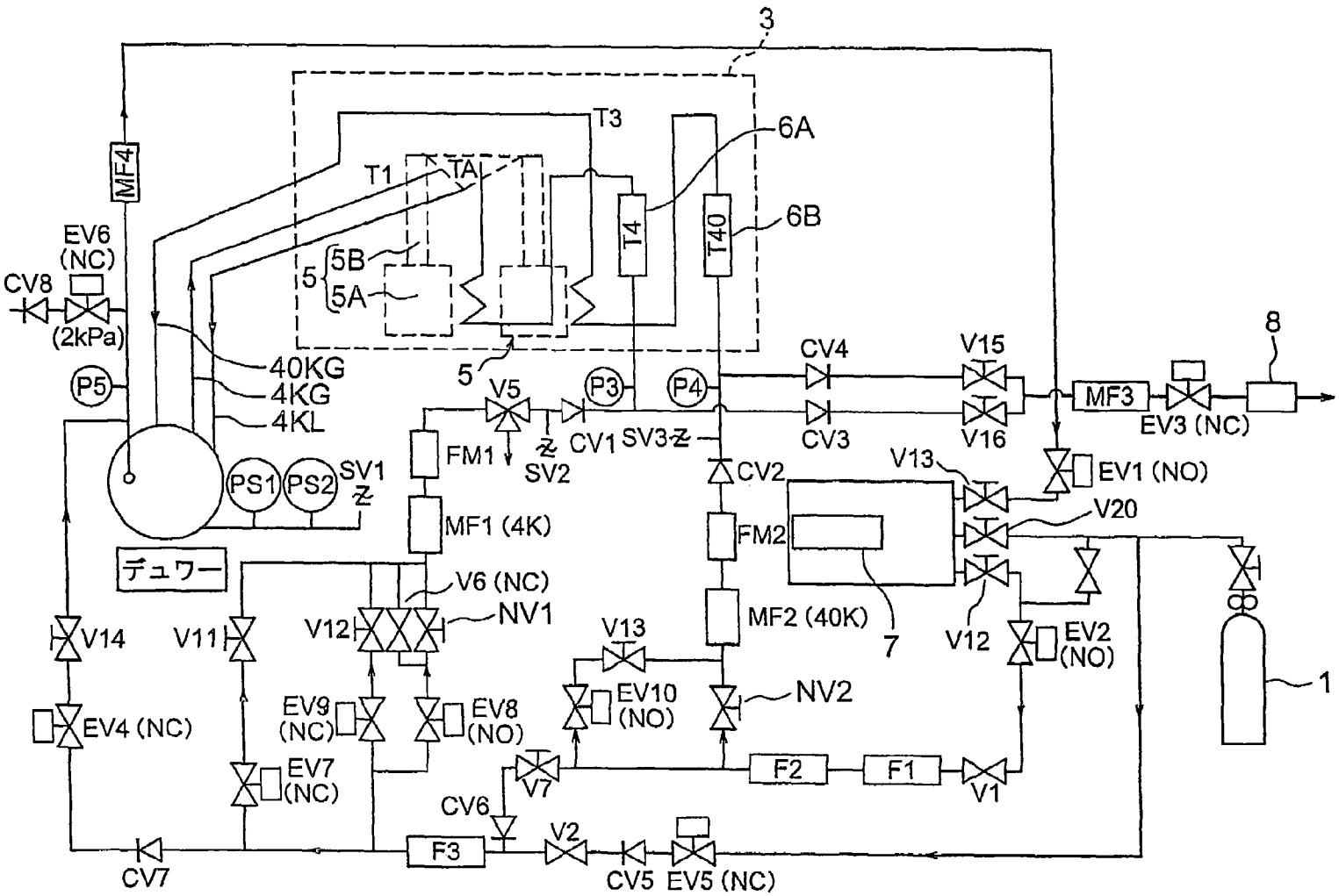
FIG. 6 shows the structure of the circulation type liquid helium recondensation device of the second embodiment of this invention.

In FIG. 6, the constant flow control valve MFC1 in the near-4K line in the first embodiment is replaced by the normally closed electromagnetic valves EV7 and EV9 and the normally open electromagnetic valve EV8, which are connected in parallel. Furthermore, the selector valves V12 and V6 and the regulating valve NV1 are installed in the passage. The capacity of the regulating valve NV1 is 0.8 liters/m in this example.

The constant flow control valve MFC2 in the near-40K line in the first embodiment is replaced by a normally open electromagnetic valve EV10 in the second embodiment. A regulating valve NV2 is connected in the passage in parallel with said electromagnetic valve EV10. The capacity of the regulating valve NV2 is 1 liter/m in this example. Helium gas is directly supplied from the helium cylinder to the circulating pump 7 via the selector valve V20. The entire device designed to the second embodiment is less expensive than that designed to the first embodiment because of the use of multiple selector valves and similar components in place of the constant flow control valves MFC. The operation of the circuits in the second embodiment (normal operation, removal of contaminants accumulated in the refiner, etc.) is basically identical with that of the first embodiment so that a description of it is omitted.

The third embodiment of this invention is described below referring to FIG. 7. In the third embodiment, the circulating pump 7, included in the device, also serves as the purge pump to discharge the vaporized contaminants from the refiner to the atmosphere instead of using an independent and dedicated purge pump 8 as used in the first and the second embodiments. In addition, the dewar 2 is not pressure-controlled to dispense with the relevant piping and to simplify the system. These features of the third embodiment are described below. Operation of the third embodiment is basically identical with that of the first embodiment so that the relevant description is omitted. The same codes used in the first and the third embodiments indicate that the relevant components are identical. EV in the drawings indicates the electromagnetic valve and V the selector valve. The numerals after EV and V indicate the position of installation of the electromagnetic valve. The other codes are to be construed likewise.

Figure 7:
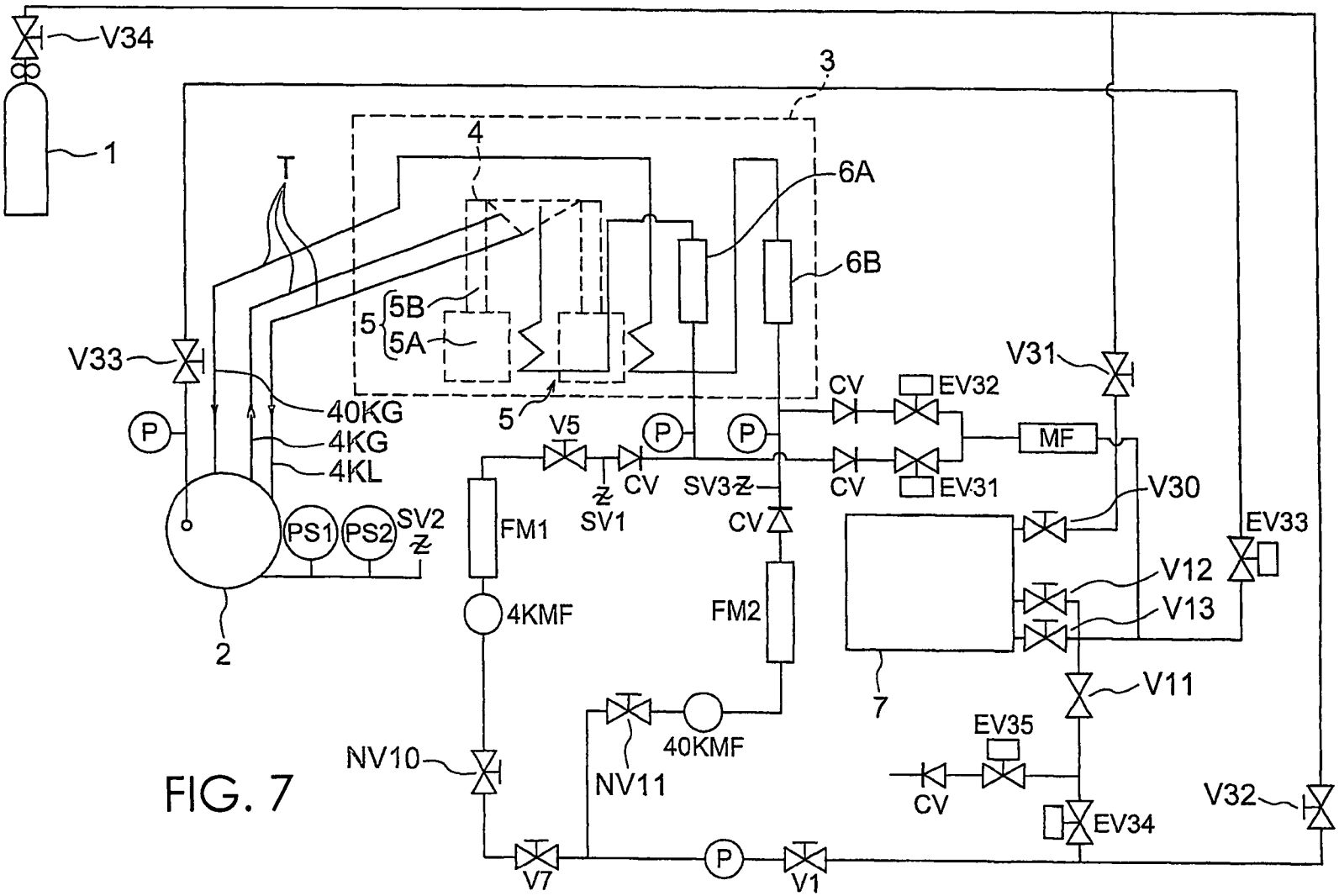
FIG. 7 shows the structure of the circulation type liquid helium recondensation device of the third embodiment of this invention.

In FIG. 7, the regulating valve NV10, mass flowmeter 4KMF, and flowmeter FM1 are connected in the near-4K line in place of the constant flow control valve MFC1 of the first embodiment. The regulating valve NV11, mass flowmeter 40KMF, and flowmeter FM2 are connected in the near-40K line in place of the constant flow control valve MFC2 of the first embodiment. Helium gas is directly supplied from the helium cylinder 1 to the circulating pump 7 or to the circuits via the selector valves V31 and V32 by opening the selector valve V34. Furthermore, a mass flowmeter MF is connected to the inflow side circuits of the 1st and the 2nd refiners 6A and 6B via a check valve CV, the normally closed electromagnetic valves EV31 and EV32, respectively. The mass flowmeter MF is connected to the inflow valve V13 of the circulating pump 7. An air vent circuit including a normally closed air vent electromagnetic valve EV35 is connected to the line between the selector valve V11 and the normally open electromagnetic valve EV34 installed downstream of the outflow valve V12 of the circulating pump.

In this circulation type liquid helium recondensation device, the helium gas evaporating in the dewar 2 flows, as is generally known and understood, through the selector valve V33, normally open electromagnetic valve EV33, inflow valve V13, circulating pump 7, outflow valve V12, and normally open electromagnetic valve EV34. The circuit then diverges in two directions. One circuit runs through the regulating valve NV10 in the near-4K line and enters the 1st refiner 6A. The other circuit extends through the regulating valve NV11 in the near-40K line and enters the 2nd refiner 6B. The product is cooled in the 1st and the 2nd cooler, respectively, and supplied to the dewar 2. This operation is the same as that of the 1st embodiment.

The contaminants accumulated in the refiner are removed by turning on the heaters in the refiner and starting the circulating pump 7 after closing the inflow valve V13 and electromagnetic valves EV33 and EV34 and opening the electromagnetic valves EV31, EV32 and EV35. The gas in the refiner 6 is pulled by the circulating pump 7 from the inflow valve V13 via the electromagnetic valves EV31 and EV32 and mass flowmeter MF, and eventually discharged to the atmosphere via outflow valve V12 and electromagnetic valve EV35. When contaminants deposit in the refiner 6, the gas in the refiner 6 can easily be vented to the atmosphere and the contaminants deposited in the refiner are purged out of the system simply by turning on the heaters of the refiner 6 to heat the refiner and vaporize the contaminants in the refiner 6 and starting the circulating pump 7 while opening the electromagnetic valves EV31, EV32 and EV35 as mentioned above. The evaporated helium gas from the dewar is mixed and suctioned at this time.

Three embodiments of this invention have been described. The refiner of this invention need not be cylindrical but may be triangular, square, etc. The upper pipe and the fins can take various forms if the above functions are achieved. The surfaces of the fins may be uneven to increase the surface area. Blockage of passages is detected by knowing flow velocity and other information in addition to temperature and pressure. Heater operating temperature, working time and other operating conditions may be freely adjustable either automatically or manually. Automatic setting, when selected, is easily implemented using a personal computer or other electrical equipment. The telescopic component may take many different shapes if the length of the thermal conductive passage between the infeed pipe and the housing can be sufficiently large. Many heater control modes are available and the most appropriate one for the application can be set freely at the design stage. The types, number and configuration of valves used in the device can be freely determined provided that the above operation is enabled.

This invention may be implemented in various other forms of embodiment without deviating from the spirit of its main features. The above-mentioned embodiments are therefore only a few examples and should not be construed as limiting.

FIELD OF THE INVENTION

The circulation type liquid helium recondensation device of this invention can be continually run for a long time period because the contaminants depositing in the refiner are vaporized by heating the refiner, and the vaporized contaminants are purged to the atmosphere using a circulating pump installed in the device. This invention furthermore features an efficient refiner best suited for recirculation systems that recovers all the helium gas evaporating in the liquid helium storage tank and recondenses and liquefies the recovered gas. The entire device can be manufactured at low cost by using two or more selector valves and other equipment in place of constant flow control valves MFC. The device can be further simplified when the circulating pump is used also as the purge pump.

What is claimed is:

1. A circulation type liquid helium recondensation device with a contaminant-purging function comprising: a pump which pumps helium gas evaporating from a liquid helium storage tank a refiner connected to the liquid helium storage tank through a first passage, which refines the pumped helium gas; a condensing pot connected to the refiner through a second passage, which liquefies the gas; and a third passage though which the liquefied helium is returned to the liquid helium storage tank; and a discharge circuit connected to the first passage between the refiner and the liquid helium storage tank, wherein the pump is connected to the discharge circuit through a normally closed valve, wherein a heater is provided in the refiner, wherein in a contaminant discharge operation, the normally closed valve is opened and contaminants that vaporize by heating the refiner by the heater are pumped by the pump and discharged to the atmosphere via said discharge circuit.

2. A circulation type liquid helium recondensation device with a contaminant-purging function as claimed in claim 1 in which a dedicated purge pump is installed in said discharge circuit to pump and discharge vaporized contaminants to the atmosphere.

3. A circulation type liquid helium recondensation device with a contaminant-purging function as claimed in claim 2 in which mass flow controllers are installed on the inflow side of said refiners to control the flow rate of the incoming helium gas.

4. A circulation type liquid helium recondensation device with a contaminant-purging function as claimed in claim 2 in which two or more valves are installed on the inflow side of the refiner to control the flow rate of the incoming helium gas by combining said valves.

5. A circulation type liquid helium recondensation device with a contaminant-purging function as claimed in claim 1 in which said discharge circuit is a circuit connecting the inflow side circuit of the refiner and the inflow valve of said circulating pump, and an electromagnetic valve for discharge is installed in said discharge circuit, and another electromagnetic valve for atmospheric discharge is installed on the downstream side of said circulating pump.

6. A circulation type liquid helium recondensation device with a contaminant-purging function as claimed in any of claims 1 through 5 in which the condensing pot is installed to store the refined helium from the refiner as gas or liquid at near-4K temperature, and said condensing pots are provided with heaters.

7. A circulation type liquid helium recondensation device with a contaminant-purging function as claimed in any of claims 1 through 5 in which said liquid helium storage tank is provided with an electromagnetic valve to regulate the pressure of the liquid helium storage tank.

8. A contaminant-purging method for the circulation type liquid helium recondensation device that is employed in liquid helium recondensation procedure comprising steps of pumping helium gas evaporating from a liquid helium storage tank using a circulating pump, refining the pumped helium gas in a refiner, liquefying the gas in a cooler, and returning the liquefied helium to the liquid helium storage tank for recycling, in which said refiner is heated to vaporize contaminants deposited on the refiner, and discharging the vaporized contaminants from an inflow side of the refiner to the atmosphere.

9. A contaminant-purging method for the circulation type liquid helium recondensation device that is employed in a liquid helium recondensation procedure comprising steps of pumping helium gas evaporating from a liquid helium storage tank using a circulating pump, refining the pumped helium gas in a refiner, liquefying the gas in a cooler, storing the liquefied helium in a condensing pot, and transferring the liquid helium from said condensing pot to the liquid helium storage tank for recycling, in which at least either of said condensing pot or said refiner is heated to vaporize the contaminants deposited on the refiner, and the vaporized contaminants are discharged from an inflow side of the refiner to the atmosphere.

10. A contaminant-purging method for the circulation type liquid helium recondensation device as claimed in claim 8 or 9 in which said vaporized contaminants are pumped by a dedicated pump and discharged to the atmosphere.

11. A contaminant-purging method for the circulation type liquid helium recondensation device as claimed in claim 8 or 9 in which said vaporized contaminants are pumped by the circulating pump and discharged to the atmosphere.

12. A contaminant-purging method for the circulation type liquid helium recondensation device as claimed in claim 9 in which heating of said condensing pot or the refiner starts when the pressure in the refiner rises to a preset level and stops when the pressure falls to a preset level.

13. A contaminant-purging method for the circulation type liquid helium recondensation device as claimed in claim 9 in which heating of said condensing pot or the refiner starts when the flow velocity in the refiner falls to a preset level and stops when the flow velocity rises to a preset level.

14. A contaminant-purging method for the circulation type liquid helium recondensation device as claimed in claim 9 in which heating and cooling of said condensing pot or the refiner is performed in the operating mode sequence of heating/back-flow, cooling, circulation recovery, and liquid level recovery.

15. A refiner for a circulation type liquid helium recondensation device with a contaminant-purging function designed to pump helium gas evaporating from a liquid helium storage tank using a circulating pump, refine the pumped helium gas in the refiner, liquefy the gas in a condensing pot, and return the liquefied helium to the liquid helium storage tank for recycling, in which said refiner is made up of a thermally conductive housing, with contaminant solidification unit installed on the housing, an infeed means to transfer helium gas to said housing, and a heating means to vaporize the contaminants attached to said solidification unit, and in which the contaminants vaporized in the refiner by said heating means are discharged from an inflow side of the refiner to the atmosphere via said infeed means.

16. A refiner for the circulation type liquid helium recondensation device with a contaminant-purging function as claimed in claim 15 in which said contaminant solidification unit is a staggered zigzag passage made up of thermally conductive fins.

17. A refiner for the circulation type liquid helium recondensation device with a contaminant-purging function as claimed in claim 15 or 16 in which said infeed means is supported on the housing via a component that reduces the thermal gradient.

18. A helium gas refiner as claimed in claim 17 in which said component to reduce the thermal gradient is a stainless steel bellows component.

19. A circulation type liquid helium recondensation device with a contaminant-purging function as claimed in claim 6 in which said liquid helium storage tank is provided with an electromagnetic valve to regulate the pressure of the liquid helium storage tank.

20. A contaminant-purging method for the circulation type liquid helium recondensation device as claimed in claim 10 in which heating of said condensing pot or the refiner starts when the pressure in the refiner rises to a preset level and stops when the pressure falls to a preset level.

21. A contaminant-purging method for the circulation type liquid helium recondensation device as claimed in claim 11 in which heating of said condensing pot or the refiner starts when the pressure in the refiner rises to a preset level and stops when the pressure falls to a preset level.

22. A contaminant-purging method for the circulation type liquid helium recondensation device as claimed in claim 10 in which heating of said condensing pot or the refiner starts when the flow velocity in the refiner falls to a preset level and stops when the flow velocity rises to a preset level.

23. A contaminant-purging method for the circulation type liquid helium recondensation device as claimed in claim 11 in which heating of said condensing pot or the refiner starts when the flow velocity in the refiner falls to a preset level and stops when the flow velocity rises to a preset level.

24. A contaminant-purging method for the circulation type liquid helium recondensation device as claimed in claim 10 in which heating and cooling of said condensing pot or the refiner is performed in the operating mode sequence of heating/back-flow, cooling, circulation recovery, and liquid level recovery.

25. A contaminant-purging method for the circulation type liquid helium recondensation device as claimed in claim 11 in which heating and cooling of said condensing pot or the refiner is performed in the operating mode sequence of heating/back-flow, cooling, circulation recovery, and liquid level recovery.

26. A contaminant-purging method for the circulation type liquid helium recondensation device as claimed in claim 12 in which heating and cooling of said condensing pot or the refiner is performed in the operating mode sequence of heating/back-flow, cooling, circulation recovery, and liquid level recovery.

27. A contaminant-purging method for the circulation type liquid helium recondensation device as claimed in claim 13 in which heating and cooling of said condensing pot or the refiner is performed in the operating mode sequence of heating/back-flow, cooling, circulation recovery, and liquid level recovery.

28. A circulation type liquid helium recondensation device with a contaminant-purging function designed to pump helium gas evaporating from a liquid helium storage tank using a circulating pump, to refine the pumped helium gas in refiners, to liquefy the gas in a condensing pot, and to return the liquefied helium to the liquid helium storage tank for recycling, in which said refiners are provided with a first heater and also a discharge circuit on the inflow side, said condensing pot is provided with a second heater, and contaminants that vaporize when the refiners and said condensing pot are heated by said first and second heaters are pumped and discharged to the atmosphere via said discharge circuit.

29. The circulation type liquid helium recondensation device with a contaminant-purging function as claimed in claim 1, wherein the refiner and the cooler are provided in a single cold box.

30. The contaminant-purging method for the circulation type liquid helium recondensation device as claimed in claim 8, wherein the refiner and the cooler are provided in a cool box.

31. The contaminant-purging method for the circulation type liquid helium recondensation device as claimed in claim 9, wherein the refiner and the cooler are provided in a cool box.

32. The contaminant-purging method for the circulation type liquid helium recondensation device as claimed in claim 15, wherein the refiner and the condensing pot are provided in a single cool box.

33. The circulation type liquid helium recondensation device with a contaminant-purging function as claimed in claim 1, wherein a flow control valve is provided in an inflow side of the refiner and between the discharge circuit and liquid helium storage tank.

* * * * *